US009057986B2

(12) United States Patent
Kawarago

(10) Patent No.: US 9,057,986 B2
(45) Date of Patent: Jun. 16, 2015

(54) SHUTTER MECHANISM, DEVELOPER ACCOMMODATING CONTAINER, PROCESS CARTRIDGE AND IMAGE FORMING APPARATUS

(71) Applicant: CANON KABUSHIKI KAISHA, Tokyo (JP)

(72) Inventor: Atsushi Kawarago, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/313,307

(22) Filed: Jun. 24, 2014

(65) Prior Publication Data

US 2014/0376972 A1 Dec. 25, 2014

(30) Foreign Application Priority Data

Jun. 25, 2013 (JP) ..... 2013-132588

(51) Int. Cl.
*G03G 15/08* (2006.01)

(52) U.S. Cl.
CPC ..... *G03G 15/0877* (2013.01); *G03G 15/0839* (2013.01)

(58) Field of Classification Search
CPC ..... G03G 15/0837; G03G 15/0839; G03G 15/0877
USPC ..... 399/106, 260, 262
See application file for complete search history.

(56) References Cited

U.S. PATENT DOCUMENTS

2011/0262180 A1* 10/2011 Suzuki ..... 399/106
2012/0033988 A1* 2/2012 Itabashi ..... 399/106
2014/0348548 A1 11/2014 Kawarago

FOREIGN PATENT DOCUMENTS

JP 2011-242528 A 12/2011

* cited by examiner

*Primary Examiner* — Hoang Ngo
(74) *Attorney, Agent, or Firm* — Fitzpatrick Cella, Harper & Scinto

(57) ABSTRACT

A shutter mechanism capable of opening and closing an opening through which a developer accommodated in a container is movable includes a shutter member movable to open and close the opening; and a limiting member for limiting movement of the shutter member in a direction of opening the opening. When the container is inclined, the limiting member moves to a position where the limiting member limits the movement of the shutter member.

8 Claims, 5 Drawing Sheets

SHUTTER MECHANISM, DEVELOPER ACCOMMODATING CONTAINER, PROCESS CARTRIDGE AND IMAGE FORMING APPARATUS

FIELD OF THE INVENTION AND RELATED ART

The present invention relates to a shutter mechanism, developer accommodating container, a process cartridge and an image forming apparatus.

In a conventional image forming apparatus such as a printer, a constitution in which a toner image (developer image) on a photosensitive drum (image bearing member) is transferred onto a sheet is used. Further, in order to improve a maintenance property and usability, the photosensitive drum and a process means actable on the photosensitive drum are integrally assembled into a cartridge (unit) detachably mountable to an image forming apparatus main assembly, and the cartridge is used. The cartridge is constituted, in some cases, by two members consisting of a drum container capable of accommodating a toner and containing the photosensitive drum and a toner container, capable of accommodating the toner, for supplying the toner (developer) to the drum container. These drum container and toner container are detachably mountable to each other. Further, in some cases, a toner collecting container is provided separately from the cartridge in order to collect the toner remaining on the photosensitive drum after transfer of the toner image. Each of the containers for transferring the toner is provided with a shutter member at a toner feeding path opening. Further, when the containers are mounted in the apparatus main assembly, the shutter members are opened to form a toner feeding path, and when the containers are demounted from the apparatus main assembly, the shutter members are closed to block the toner feeding path, thus preventing toner leakage or the like. Particularly, in recent years, the improvements in maintenance property and usability are required more than ever before, so that leakage prevention by the shutter members is increasingly needed. Therefore, Japanese Laid-Open Patent Application (JP-A) 2011-242528 proposes a constitution in which a shape of the shutter members is devised to enhance a sealing property.

According to the constitution of JP-A 2011-242528, an elastic portion for enhancing the sealing property is gradually compressed from end portions toward a central portion during a closing operation of the shutter member provided on the toner container. As a result, a smooth operation of the shutter member is enabled, so that it is possible to prevent deformation of the elastic portion, thus suppressing a lowering in sealing property. By employing such a constitution, it becomes possible to provide the toner container including the shutter member with a high sealing property.

However, according to the constitution of JP-A 2011-242528, the sealing property of the shutter member was enhanced, but on the other hand, in a state in which the toner container is inclined in a direction in which the toner leaks out through an opening of the toner container, there was the case where a service person or a user erroneously performs an opening operation of the shutter member. In that case, there is a possibility that leakage of the toner from the toner container occurs.

Here, in order to explain the leakage of the toner due to the inclination of the container, a shutter mechanism constitution used in a conventional example will be described with reference to (a) to (c) of FIG. 5 and FIG. 6. In FIG. 5, (a) to (c) are schematic partial perspective views for illustrating open and closed states of the shutter mechanism in the conventional example. In FIG. 5, (a) shows a closed state of a drum container-side receiving opening shutter, (b) shows a state in which the drum container-side receiving opening shutter is partly opened, and (c) shows an opened state of the drum container-side receiving opening shutter. FIG. 6 is a schematic partial perspective view of the shutter mechanism used in the conventional example. The shutter mechanism in the conventional example shown in FIG. 5 includes a drum container-side receiving opening 108*a* provided at an upper portion of a drum container 108 and a drum container-side receiving opening shutter 108*b*. The drum container-side receiving opening shutter 108*b* is held rotatably in an arrow G direction in (a) of FIG. 5. Further, the drum container-side receiving opening shutter 108*b* is, in a state in which the drum container 108 is taken out from an apparatus main assembly, urged to and held at a position of (a) of FIG. 5, by an unshown urging means, where the shutter 108*b* closes the drum container-side receiving opening 108*a*. For that reason, the drum container-side receiving opening shutter 108*b* prevents the toner from leaking out through the drum container-side receiving opening 108*a*.

When the drum container 108 is mounted in the apparatus main assembly and then a toner container is mounted in the apparatus main assembly, a part of the toner container presses a drum container-side receiving opening shutter contact rib 108*c* in an arrow H direction of (a) of FIG. 5. Then, the drum container-side receiving opening shutter 108*b* is rotated in a direction in which the drum container-side receiving opening 108*a* is opened. Then, the drum container-side receiving opening shutter 108*b* is rotated via the partly opened state shown in (b) of FIG. 5, and then opens the drum container-side receiving opening 108*a* as shown in (c) of FIG. 5, so that a toner feeding path in which the toner is movable (capable of going in and out) is formed.

Here, for example, when the drum container 108 is taken out from the apparatus main assembly and then is carried, in a state in which the drum container 108 is inclined in an arrow J direction in FIG. 6, in some cases, the drum container-side receiving opening shutter contact rib 108*c* is erroneously urged. In that case, when the urging (pressing) direction coincides with a direction (arrow H direction in (a) of FIG. 5) in which the drum container-side receiving opening shutter 108*b* is opened, there was a fear that the shutter is opened to cause the leakage of the toner.

SUMMARY OF THE INVENTION

In view of the above problem, a principal object of the present invention is to prevent leakage of a toner through an opening when a container is inclined.

According to an aspect of the present invention, there is provided a shutter mechanism capable of opening and closing an opening through which a developer accommodated in a container is movable, the shutter mechanism comprising: a shutter member movable to open and close the opening; and a limiting member for limiting movement of the shutter member in a direction of opening the opening, wherein when the container is inclined, the limiting member moves to a position where the limiting member limits the movement of the shutter member.

According to another aspect of the present invention, there is provided a developer accommodating container, in which a developer is accommodated, including an opening through which the developer is movable, the developer accommodating container comprising: a shutter member movable to open and close the opening; and a limiting member for limiting movement of the shutter member in a direction of opening the opening, wherein when the developer accommodating container is inclined, the limiting member moves to a position where the limiting member limits the movement of the shutter member.

According to another aspect of the present invention, there is provided a process cartridge detachably mountable to a main assembly of an image forming apparatus, comprising: a process means for performing an image forming process; and the developer accommodating container described above.

According to a further aspect of the present invention, there is provided an image forming apparatus comprising: an image bearing member for bearing an image; and the developer accommodating container described above, wherein the image is formed with the developer accommodated in the developer accommodating container.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments for carrying out the present invention will be specifically described with reference to the drawings. Dimensions, materials, shapes and relative arrangement of constituent elements described in the following embodiment should be appropriately be changed depending on structures and various conditions of devices (apparatuses) to which the present invention is applied. Accordingly, unless otherwise specified, the scope of the present invention is not intended to be limited thereto.

<Image Forming Apparatus>

Figure 1:
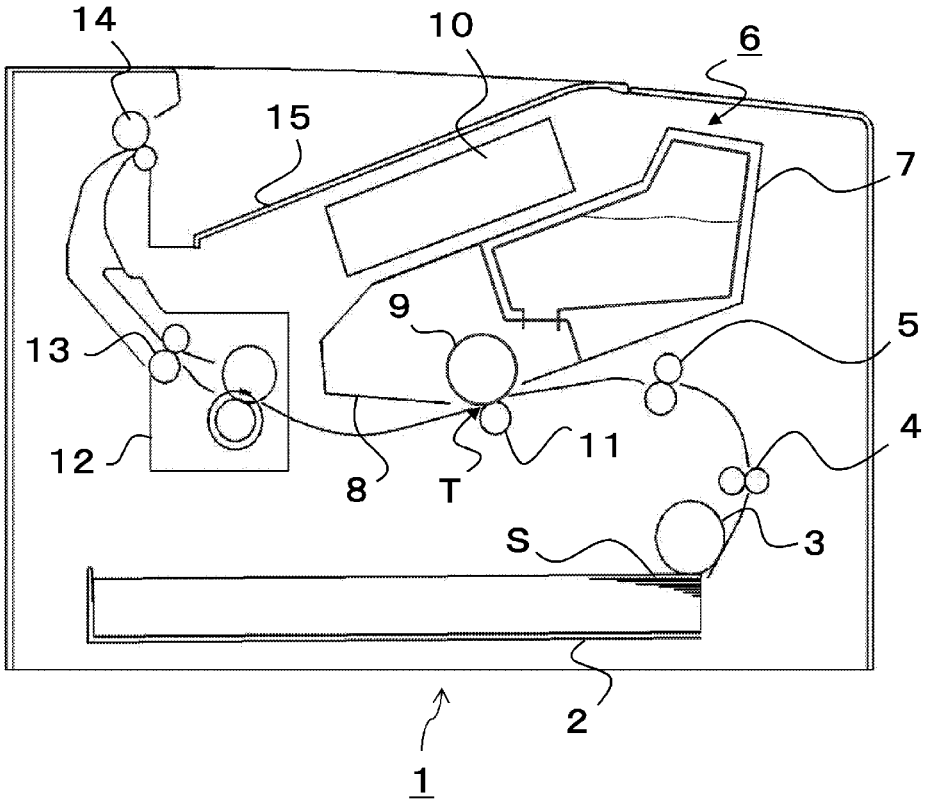
FIG. 1 is a schematic sectional view showing an image forming apparatus according to an embodiment.

First, with reference to FIG. 1, a general structure of an image forming apparatus according to an embodiment of the present invention will be described. FIG. 1 is a schematic sectional view showing an image forming apparatus in this embodiment. As shown in FIG. 1, an apparatus main assembly 1 of the image forming apparatus in this embodiment includes a sheet feeding cassette 2, a sheet feeding roller 3, conveyor roller pairs 4 and 5, a laser scanner 10, a transfer roller 11, a fixing device 12, conveyor roller pairs 13 and 14, a discharge portion 15. Further, the apparatus main assembly 1 includes a cartridge 6 provided detachably mountable thereto. The cartridge 6 is a process cartridge including a drum 9 as an image bearing member for bearing an image and process means, actable on the drum 9, for performing an image forming process.

The cartridge 6 is constituted by a toner container 7 capable of accommodating a toner as a developer and by a drum container 8 capable of accommodating the toner. In this embodiment, in the toner container 7, the toner for being fed into the drum container 8 is accommodated. Further, the drum container 8 as a developer container includes the drum 9 as the image bearing member.

Here, an outline of an image forming operation in this embodiment will be described. First, a sheet S stacked in the sheet feeding cassette 2 detachably mountable to the apparatus main assembly 1 is separated and fed one by one by the sheet feeding roller 3, and then is conveyed by the conveyor roller pairs 4 and 5, to a the transfer portion T as a contact portion between the drum 9 and the transfer roller 11.

On the other hand, on the drum 9 provided in the drum container 8, a latent image is formed by irradiation with laser light emitted from the laser scanner 10. Then, the latent image is supplied with the toner from the toner container 7, so that a toner image is formed on the drum 9.

Onto the conveyed sheet S, the toner image is transferred at the transfer portion T. The sheet S on which the toner image is transferred is conveyed to the fixing device 12. The toner image is heated and pressed by the fixing device 12, so that the toner image is fixed on the sheets. The sheet S on which the toner image is fixed is discharged onto the discharge portion 15 by the conveyor roller pairs 13 and 14.

<Structure of Shutter Mechanism>

Figure 2:
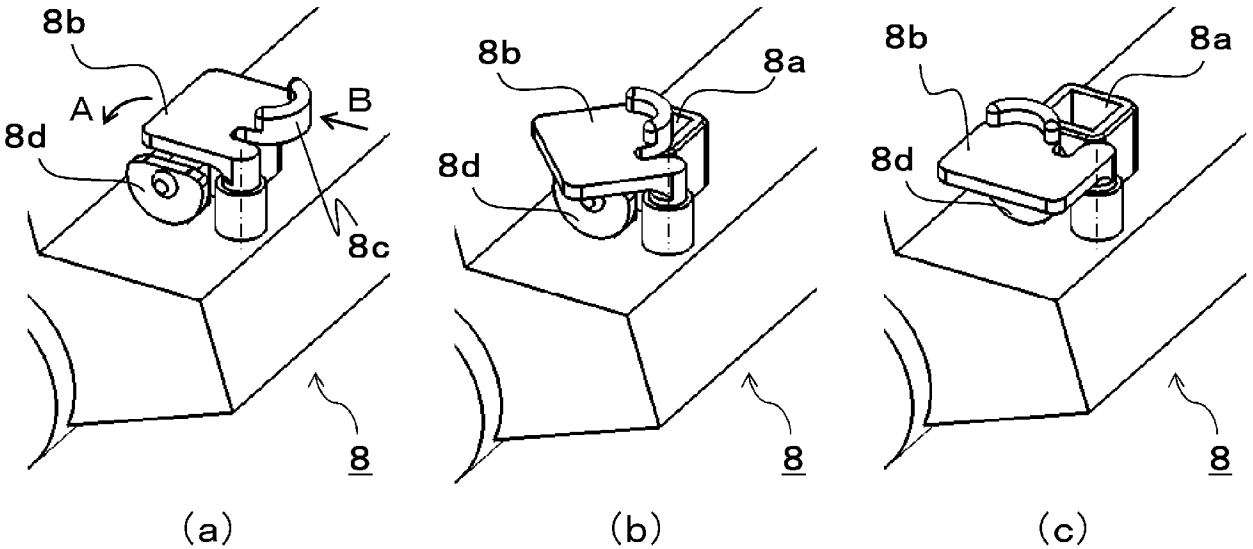
In FIG. 2 is (a) to (c) are schematic partial perspective views for illustrating opened and closed states of a shutter mechanism in the embodiment.

Next, with reference to FIG. 2, a structure of the shutter mechanism in this embodiment will be described. In FIG. 2, (a) to (c) are schematic partial perspective views for illustrating opened and closed states of the shutter mechanism. In FIG. 2, (a) shows a closed state of a drum container-side receiving opening shutter, (b) shows a state in which the drum container-side receiving opening shutter is partly opened, and (c) shows an opened state of the drum container-side receiving opening shutter.

The shutter mechanism in this embodiment includes a drum container-side receiving opening 8*a* as an opening, a drum container-side receiving opening shutter 8*b* as a shutter member, and a drum container-side receiving opening shutter lock 8*d* as a limiting member. The drum container-side receiving opening 8*a* is provided at an upper portion of the drum container 8. Further, the drum container-side receiving opening shutter 8*b* is provided with a drum container-side receiving opening shutter contact rib 8*c*.

The drum container-side receiving opening 8*a* is the opening through which the toner accommodated in the drum container 8 is capable of being discharged and the toner can enter the drum container 8. The drum container-side receiving opening shutter 8*b* is provided so as to be capable of opening and closing the drum container-side receiving opening 8*a*.

The drum container-side receiving opening shutter 108*b* is provided, at an upper surface of the drum container-side receiving opening 108*a*, rotatably in an arrow A direction in (a) of FIG. 2. Further, the drum container-side receiving opening shutter 108*b* is, in a state in which the drum container 108 is not mounted in the apparatus main assembly, urged and held by an unshown drum container-side receiving opening shutter spring so as to be placed in a state of (a) of FIG. 2 in which the shutter 108*b* closes the drum container-side receiving opening 108*a*. For that reason, in the state in which the drum container 8 is not mounted in the apparatus main assembly 1, the drum container-side receiving opening shutter 108*b* prevents the toner from leaking out through the drum container-side receiving opening 108*a*.

In a state in which the drum container 108 is mounted in the apparatus main assembly 1, when the a toner container 7 is mounted in the apparatus main assembly 1, an unshown urging (pressing) portion provided on the toner container 7 presses the drum container-side receiving opening shutter contact rib 108*c* in an arrow B direction of (a) of FIG. 2. Then, the drum container-side receiving opening shutter 108*b* is rotated in a direction (arrow A direction in (a) of FIG. 2) in which the drum container-side receiving opening 108*a* is opened. Then, the drum container-side receiving opening shutter 108*b* is rotated via the partly opened state shown in (b) of FIG. 2, and then opens the drum container-side receiving opening 108*a* as shown in (c) of FIG. 2, so that a toner feeding path in which the toner is movable (capable of going in and out) is formed.

<Lock Operation>

Figure 3:
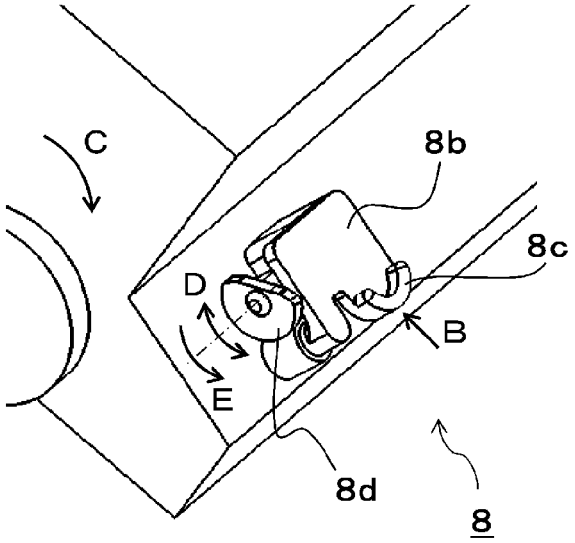
FIG. 3 is a schematic partial perspective views showing a locked state of a drum container-side receiving opening.
Figure 4:
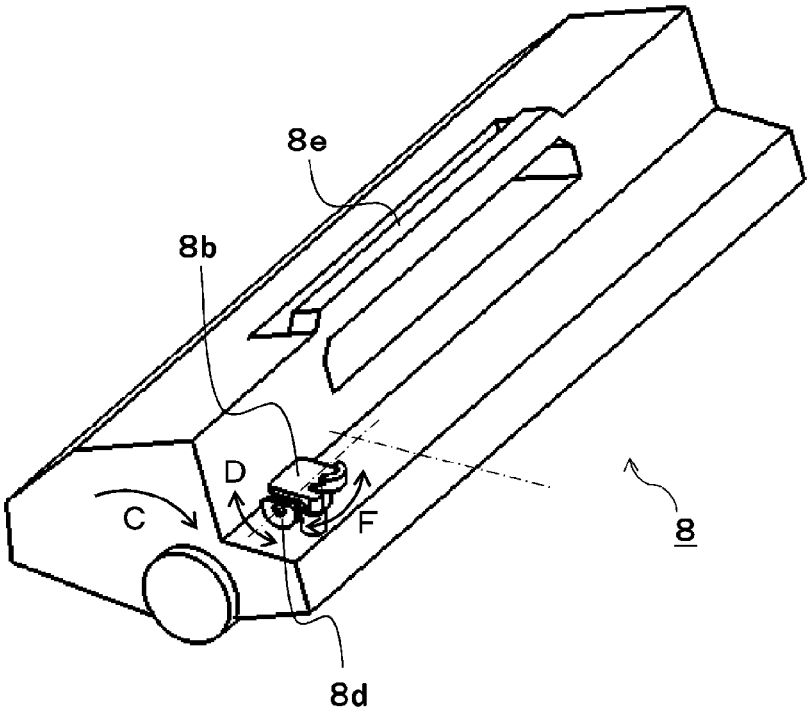
FIG. 4 is a schematic perspective view for showing a whole of a drum container.
Figure 5:
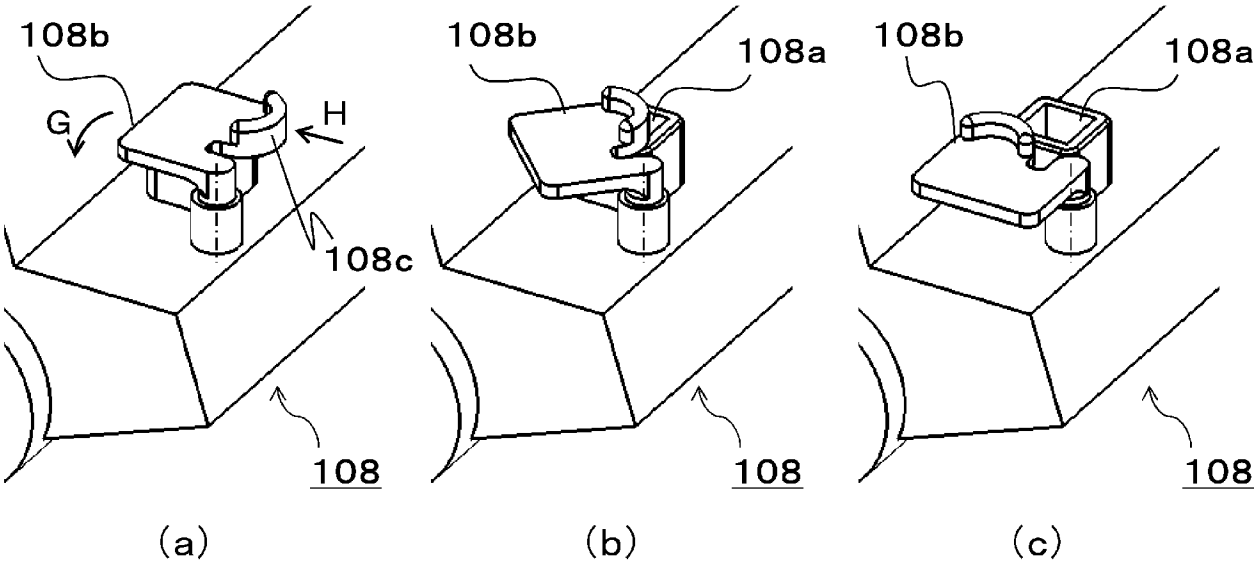
In FIG. 5, (a) to (c) are schematic partial perspective views for illustrating opened and closed states of a shutter mechanism in a conventional example.
Figure 6:
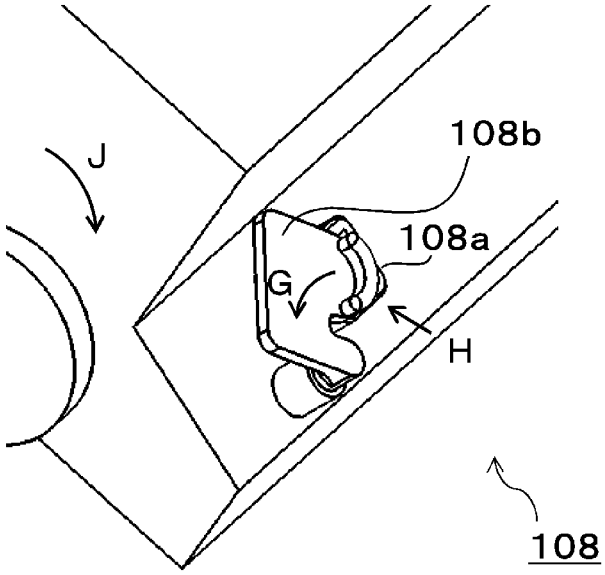
FIG. 6 is a schematic partial perspective view of the shutter mechanism in the conventional example.

Next, with reference to FIGS. 3 and 4, a lock operation of the drum container-side receiving opening shutter lock will be described. FIG. 3 is a schematic partial perspective view showing a locked state of the drum container-side receiving opening shutter. FIG. 4 is a schematic perspective view showing a whole of the drum container.

The drum container-side receiving opening shutter lock 8*d* is a member for limiting movement of the drum container-side receiving opening shutter 8*b* in the direction of opening the drum container-side receiving opening 8*a*. In this embodiment, when the drum container 8 is inclined in a toner leaking direction, this drum container-side receiving opening shutter lock 8*d* moves to a position where the movement of the drum container-side receiving opening shutter 8*b* in the direction of opening the drum container-side receiving opening 8*a* is limited. The position where the movement of the drum container-side receiving opening shutter 8*b* in the direction of opening the drum container-side receiving opening 8*a* is a position, on a locus of the rotational movement of the drum container-side receiving opening shutter 8*b*, where the shutter lock 8*d* contacts the rotated drum container-side receiving opening shutter 8*b*. Further, in this embodiment, the direction in which the toner leaks out through the drum container-side receiving opening 8*a* is an arrow C direction in FIGS. 3 and 4. In an operation state of the drum container 8, i.e., in a state in which the drum container-side receiving opening 8*a* is located at a position where the drum container-side receiving opening 8*a* opens to above with respect to a vertical direction, when the drum container 8 is inclined in the arrow C direction, there is a fear that the toner leaks out from the drum container-side receiving opening shutter 8*b*.

As shown in FIG. 3, the drum container-side receiving opening shutter lock 8*d* is disposed in the neighborhood of the drum container-side receiving opening shutter 8*b*. Specifically, the drum container-side receiving opening shutter lock 8*d* is disposed in the neighborhood of the drum container-side receiving opening shutter 8*b* so as to be swingable (rotatable) about a center axis thereof by a self-weight thereof.

Further, the drum container-side receiving opening shutter lock 8*d* is held rotatably (movably) in a direction (arrow D direction in FIG. 3) perpendicular to the rotational direction (movement direction) of the drum container-side receiving opening shutter 8*b*. The reason why the shutter lock 8*d* is rotatable in the arrow D direction as described above is that the shutter lock 8*d* is disposed correspondingly to a direction in which the drum container 8 is easily inclined when the service person or the user takes out the drum container 8 while holding a drum container handle 8*e* (FIG. 4) extending in a longitudinal direction of the drum container 8.

In a state in which the drum container 8 is not inclined, the drum container-side receiving opening shutter lock 8*d* is held at the position of (a) of FIG. 2 by the self-weight thereof. In that state, when the toner container 7 is mounted in the apparatus main assembly 1, the drum container-side receiving opening shutter contact rib 8*c* is urged, so that the drum container-side receiving opening shutter 8*b* reaches the position shown in (c) of FIG. 2. At that time, the drum container-side receiving opening shutter lock 8*d* is held at the position of (a) of FIG. 2, and therefore the shutter lock 8*d* does not cross a rotation locus of the drum container-side receiving opening shutter 8*b*, so that the shutter lock 8*d* does not limit the movement of the drum container-side receiving opening shutter 8*b* in the direction of opening the drum container-side receiving opening 8*a*.

On the other hand, when the drum container 8 is inclined in the direction (arrow C direction) in which the toner leaks out through the drum container-side receiving opening 8*a*, the drum container-side receiving opening shutter lock 8*d* is rotated in an arrow E direction in FIG. 3 by the self-weight thereof. That is, the drum container-side receiving opening shutter lock 8*d* is rotated in a direction (arrow H direction) opposite to the inclination direction (arrow C direction) of the drum container 8.

The rotated drum container-side receiving opening shutter lock 8*d* is located at a position on the rotation locus of the drum container-side receiving opening shutter 8*b*, and limits the rotational movement of the drum container-side receiving opening shutter 8*b*. That is, in this embodiment, a constitution in which a movement locus of the drum container-side receiving opening shutter lock 8*d* and a movement locus of the drum container-side receiving opening shutter 8*b* intersect with each other is employed.

As described above, in this embodiment, when the drum container 8 is inclined in the direction in which the toner leaks out through the drum container-side receiving opening 8*a*, the drum container-side receiving opening shutter lock 8*d* limits the movement of the drum container-side receiving opening shutter 8*b*. Accordingly, e.g., when the drum container 8 is taken out from the apparatus main assembly 1 and then is carried, as shown in FIG. 3, even in the case where the service person or the user erroneously inclines the drum container 8 to urge the drum container-side receiving opening shutter contact rib 8*c*, the drum container-side receiving opening shutter 8*b* is not opened.

Incidentally, in the case where the drum container 8 is inclined in the direction opposite to the arrow C direction in FIG. 3, also the drum container-side receiving opening shutter lock 8*d* is rotated similarly in a direction opposite to the arrow E direction in FIG. 3, so that the rotational movement of the drum container-side receiving opening shutter 8*b* is limited.

Incidentally, the constitution in this embodiment is intended to meet also an inclination of the drum container 8 in a direction perpendicular to the arrow C direction in FIG. 3, a drum container-side receiving opening shutter lock (not shown) rotatable in an arrow F direction in FIG. 4 may only be required to be added. Further, in this embodiment, the operations of the drum container-side receiving opening shutter 8*b* and the drum container-side receiving opening shutter lock 8*d* are the rotational movement, but are not limited thereto. The operations may also be a reciprocating operation.

Incidentally, the constitution in which the shutter mechanism in this embodiment is provided on the drum container 8 is employed, but the present invention is not limited thereto. A constitution in which the shutter mechanism in this embodiment is provided on the toner container 7 as the developer container may also be employed. Further, even when the container is a collecting container for collecting a residual toner, if the collecting container is a container capable of accommodating the toner, it is possible to employ the shutter mechanism in this embodiment.

According to the present invention, when the container is inclined, it is possible to suppress leakage out of the toner through the opening.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 132588/2013 filed Jun. 25, 2013, which is hereby incorporated by reference.

What is claimed is:

1. A shutter mechanism capable of opening and closing an opening through which a developer accommodated in a container is movable, said shutter mechanism comprising:

a shutter member movable to open and close the opening; and a limiting member for limiting movement of said shutter member in a direction of opening the opening, wherein when the container is inclined, said limiting member moves to a position where said limiting member limits the movement of said shutter member.

2. A shutter mechanism according to claim 1, wherein said limiting member is provided movably by a self-weight thereof, and when the container is inclined, moves in a direction opposite to an inclination direction of the container.

3. A shutter mechanism according to claim 2, wherein a movement locus of said shutter member and a movement locus of said limiting member cross each other.

4. A developer accommodating container, in which a developer is accommodated, including an opening through which the developer is movable, said developer accommodating container comprising:

a shutter member movable so as to be capable of opening and closing the opening; and a limiting member for limiting movement of said shutter member in a direction of opening the opening, wherein when said developer accommodating container is inclined, said limiting member moves to a position where said limiting member limits the movement of said shutter member.

5. A developer accommodating container according to claim 4, wherein said limiting member is provided movably by a self-weight thereof, and when said developer accommodating container is inclined, moves in a direction opposite to an inclination direction of said developer accommodating container.

6. A developer accommodating container according to claim 5, wherein a movement locus of said shutter member and a movement locus of said limiting member cross each other.

7. A process cartridge detachably mountable to a main assembly of an image forming apparatus, comprising:

a process means for performing an image forming process; and a developer accommodating container according to claim 5.

8. An image forming apparatus comprising:

an image bearing member for bearing an image; and a developer accommodating container according to claim 4, wherein the image is formed with the developer accommodated in said developer accommodating container.

* * * * *